US006068535A

United States Patent [19]

Hoyt

[11] Patent Number: 6,068,535

[45] Date of Patent: May 30, 2000

[54] POWERED INFANT MOBILE

[76] Inventor: Kevin O. Hoyt, 1804 Monte Alban Dr., N. Las Vegas, Nev. 89031

[21] Appl. No.: 09/337,692

[22] Filed: Jun. 22, 1999

[51] Int. Cl.[7] ..... A63H 11/00

[52] U.S. Cl. ..... 446/227; 446/396; 446/489

[58] Field of Search ..... 446/227, 230, 446/325, 326, 396, 489

[56] References Cited

U.S. PATENT DOCUMENTS

| | | | |
|---|---|---|---|
| D. 383,172 | 9/1997 | Allegie . | |
| 2,769,276 | 11/1956 | Steiner . | |
| 2,994,156 | 8/1961 | Steiner et al. . | |
| 3,014,307 | 12/1961 | Dupuis . | |
| 3,564,759 | 2/1971 | Buttermore . | |
| 3,699,704 | 10/1972 | Hakim | 446/227 |
| 3,750,308 | 8/1973 | Nelson | 446/396 |
| 3,978,610 | 9/1976 | Stubbmann | 446/227 |
| 4,640,034 | 2/1987 | Zisholtz | 446/227 |
| 4,722,713 | 2/1988 | Williams et al. | 446/227 |
| 5,352,145 | 10/1994 | Raiffe et al. | 446/227 |

*Primary Examiner*—Robert A. Hafer
*Assistant Examiner*—Jeffrey D. Carlson
*Attorney, Agent, or Firm*—Joseph N. Breaux

[57] ABSTRACT

A powered infant mobile that includes a number of detachable mobile elements to allow a child to hold and play with the mobile elements when desired. Because removal of one or more mobile elements from the infant mobile can unbalance the mobile, the powered infant mobile is provided with balancing elements that are positionable by a user to allow the user to balance the mobile after removing one or more of the mobile elements.

1 Claim, 3 Drawing Sheets

POWERED INFANT MOBILE

TECHNICAL FIELD

The present invention relates to infant mobiles and more particularly to a powered infant mobile that includes a drive assembly including a motor housing having a timer select switch provided on the exterior thereof, a battery powered drive motor controlled by the timer select switch and rigidly coupled to the interior of the motor housing such that a rotatable shaft extends outwardly from the motor housing through a top surface thereof, the rotatable shaft terminating in a hanging ring, operation of the battery powered drive motor causing the motor housing to rotate with respect to the rotatable shaft; a mobile support frame including a vertical center member having a top end fixedly attached to a center of the bottom surface of the motor housing and extending downwardly away from the bottom surface of the motor housing terminating at a far end in a mobile element detachable attachment mechanism and four equally spaced, equally sized L-shaped support arms each including a long portion and a short portion, each long portion extending radially from the same section of the vertical center member at a location between the far end and the top end, each long portion having a slidable balancing element provided thereon for allowing a user to balance the mobile support frame such that the vertical center member is maintained in a vertical orientation, each short portion being oriented downward away from the motor housing and terminating in a mobile element detachable attachment mechanism; and at least five mobile elements each having a frame detachable attachment mechanism companionate with a mobile element detachable attachment mechanism for detachably attaching each mobile element to the mobile support frame.

BACKGROUND ART

Infant mobiles having a number of mobile elements positioned over a crib, play pen or the like can provide desirable stimulation for infants and small children who are confined in these structures. Because movement of the mobile elements can provide additional stimulation, it would be desirable to have an infant mobile that was powered and which moved the mobile elements to hold the attention of the infant or small child. Because children and infants are typically more interested in mobile items that have been touched smelled, tasted and held by the infant or child, it would be a further benefit to have an infant mobile that included detachable mobile elements that could be detached from the mobile to allow the child to hold and play with the mobile elements when desired. Because removal of one or more mobile elements from the infant mobile can unbalance the mobile, it would be a still further benefit to have an infant mobile that included balancing elements that allowed the user to balance the mobile after removing one or more of the mobile elements.

GENERAL SUMMARY DISCUSSION OF INVENTION

It is thus an object of the invention to provide a powered infant mobile that includes a drive assembly including a motor housing having a timer select switch provided on the exterior thereof, a battery powered drive motor controlled by the timer select switch and rigidly coupled to the interior of the motor housing such that a rotatable shaft extends outwardly from the motor housing through a top surface thereof, the rotatable shaft terminating in a hanging ring, operation of the battery powered drive motor causing the motor housing to rotate with respect to the rotatable shaft; a mobile support frame including a vertical center member having a top end fixedly attached to a center of the bottom surface of the motor housing and extending downwardly away from the bottom surface of the motor housing terminating at a far end in a mobile element detachable attachment mechanism and four equally spaced, equally sized L-shaped support arms each including a long portion and a short portion, each long portion extending radially from the same section of the vertical center member at a location between the far end and the top end, each long portion having a slidable balancing element provided thereon for allowing a user to balance the mobile support frame such that the vertical center member is maintained in a vertical orientation, each short portion being oriented downward away from the motor housing and terminating in a mobile element detachable attachment mechanism; and at least five mobile elements each having a frame detachable attachment mechanism companionate with a mobile element detachable attachment mechanism for detachably attaching each mobile element to the mobile support frame.

Accordingly, a powered infant mobile is provided. The powered infant mobile includes a drive assembly including a motor housing having a timer select switch provided on the exterior thereof, a battery powered drive motor controlled by the timer select switch and rigidly coupled to the interior of the motor housing such that a rotatable shaft extends outwardly from the motor housing through a top surface thereof, the rotatable shaft terminating in a hanging ring, operation of the battery powered drive motor causing the motor housing to rotate with respect to the rotatable shaft; a mobile support frame including a vertical center member having a top end fixedly attached to a center of the bottom surface of the motor housing and extending downwardly away from the bottom surface of the motor housing terminating at a far end in a mobile element detachable attachment mechanism and four equally spaced, equally sized L-shaped support arms each including a long portion and a short portion, each long portion extending radially from the same section of the vertical center member at a location between the far end and the top end, each long portion having a slidable balancing element provided thereon for allowing a user to balance the mobile support frame such that the vertical center member is maintained in a vertical orientation, each short portion being oriented downward away from the motor housing and terminating in a mobile element detachable attachment mechanism; and at least five mobile elements each having a frame detachable attachment mechanism companionate with a mobile element detachable attachment mechanism for detachably attaching each mobile element to the mobile support frame.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
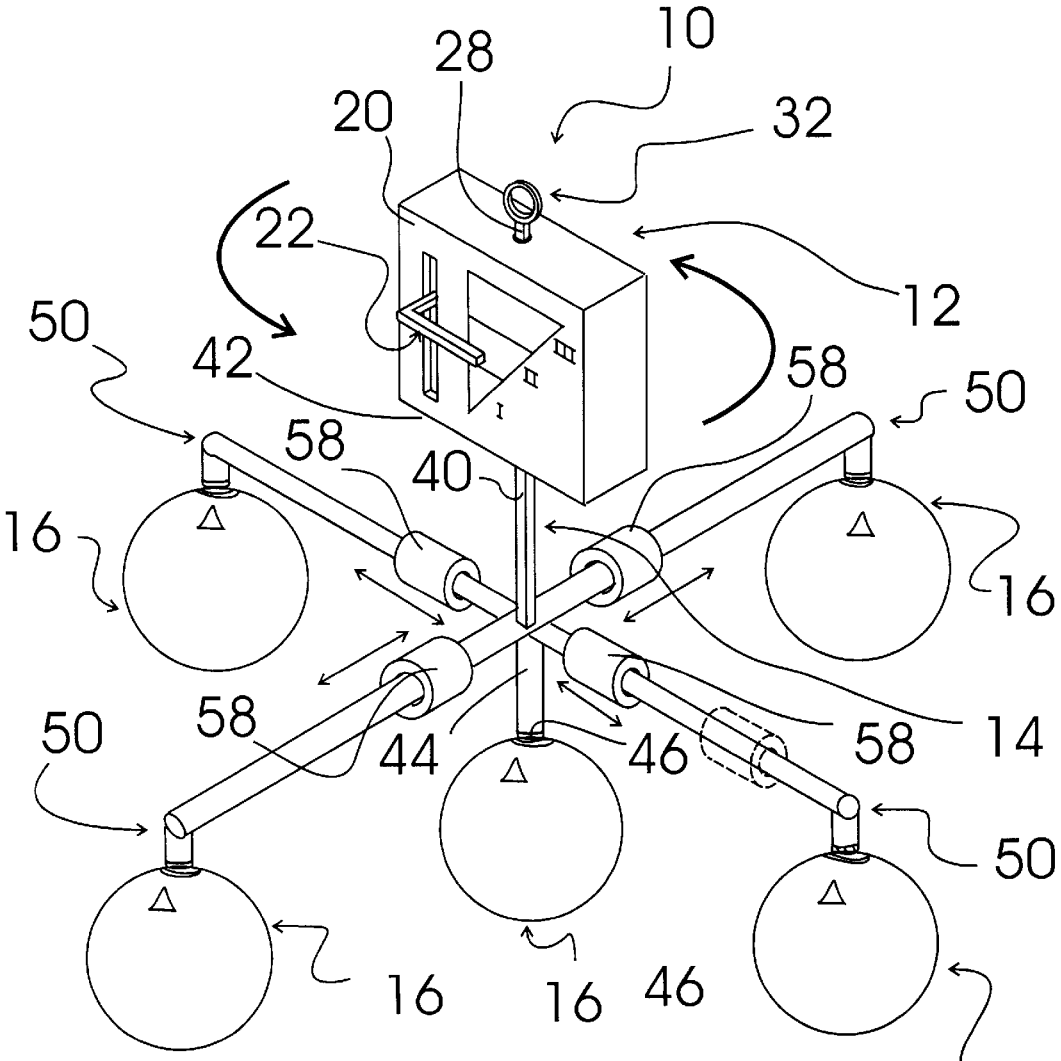
FIG. 1 is a perspective view of an exemplary embodiment of the powered infant mobile of the present invention showing the drive assembly including a motor housing having a timer select switch provided on the exterior thereof, a battery powered drive motor controlled by the timer select switch and rigidly coupled to the interior of the motor housing such that a rotatable shaft extends outwardly from the motor housing through a top surface thereof, the rotatable shaft terminating in a hanging ring, operation of the battery powered drive motor causing the motor housing to rotate with respect to the rotatable shaft; a mobile support frame including a vertical center member having a top end fixedly attached to a center of the bottom surface of the motor housing and extending downwardly away from the bottom surface of the motor housing terminating at a far end in a mobile element detachable attachment mechanism and four equally spaced, equally sized L-shaped support arms each including a long portion and a short portion, each long portion extending radially from the same section of the vertical center member at a location between the far end and the top end, each long portion having a slidable balancing element provided thereon for allowing a user to balance the mobile support frame such that the vertical center member is maintained in a vertical orientation, each short portion being oriented downward away from the motor housing and terminating in a mobile element detachable attachment mechanism; and at least five mobile elements each having a frame detachable attachment mechanism companionate with a mobile element detachable attachment mechanism for detachably attaching each mobile element to the mobile support frame.

FIG. 1 shows an exemplary embodiment of the powered infant mobile of the present invention generally designated 10. Powered infant mobile 10 includes a drive assembly, generally designated 12; a mobile support frame, generally designated 14; and five mobile elements, each generally designated 16.

Figure 2:
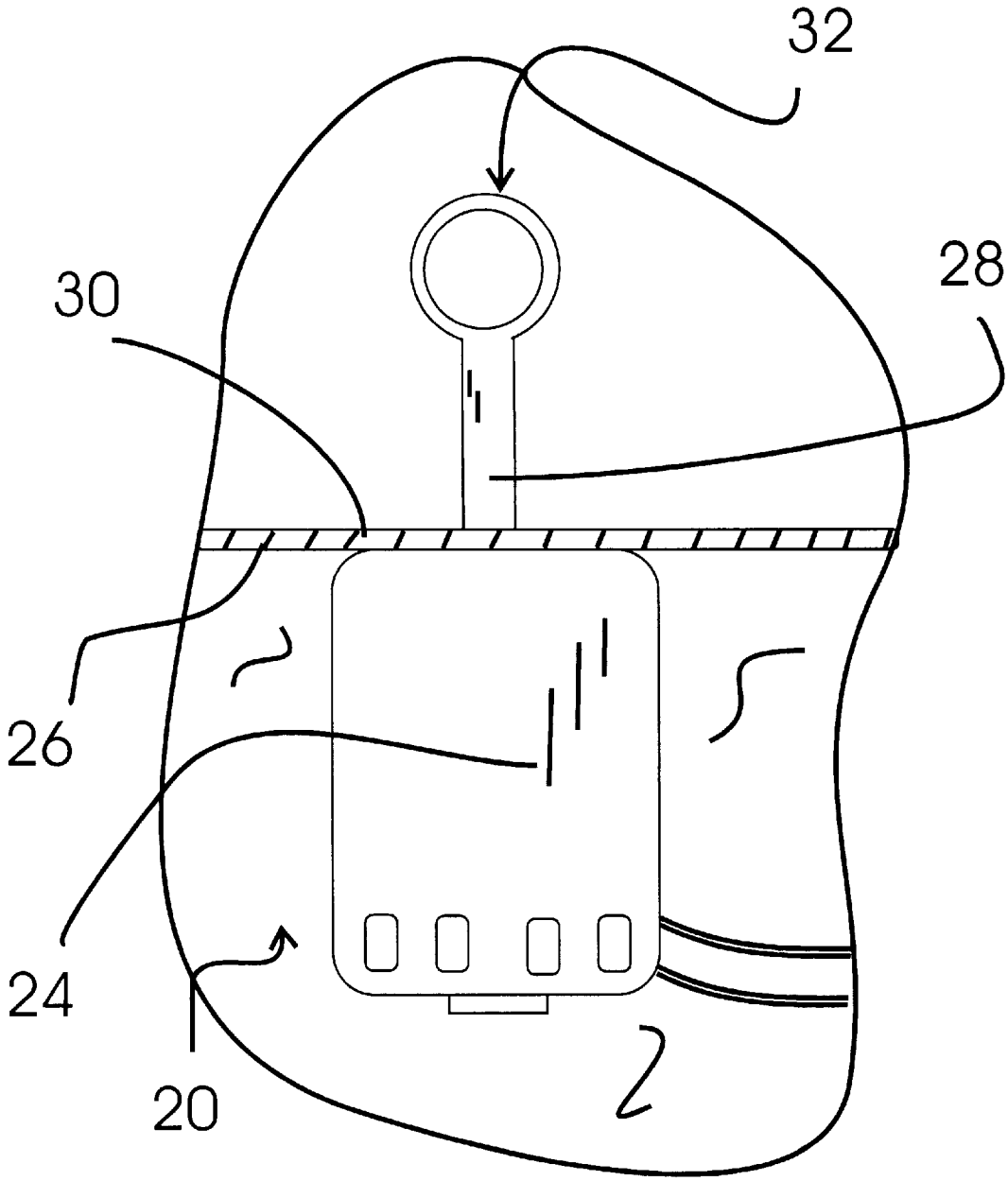
FIG. 2 is a partial cutaway view showing the battery powered drive motor rigidly attached to an upper interior wall of the motor housing, the rotatable shaft extending through a shaft aperture formed through the motor housing, and the hanging ring at the end of the rotatable shaft for attachment of the powered mobile to a support arm.

Drive assembly 12 includes a motor housing 20 having a timer select switch 22 provided on the exterior thereof, a battery powered drive motor 24 (FIG. 2) controlled by timer select switch 22 and, referring now to FIG. 2, rigidly coupled to an interior surface 26 of the motor housing 20 such that a rotatable shaft 28 of battery powered motor 24 extends outwardly through a top surface 30 of motor housing 20. Rotatable shaft 28 terminates in a hanging ring 32 used, referring back to FIG. 1, to attach powered infant mobile to a support above a crib, playpen or the like. Operation of battery powered drive motor 24 (FIG. 2) causes the motor housing 20 to rotate with respect to rotatable shaft 28 and hanging ring 32.

Figure 3:
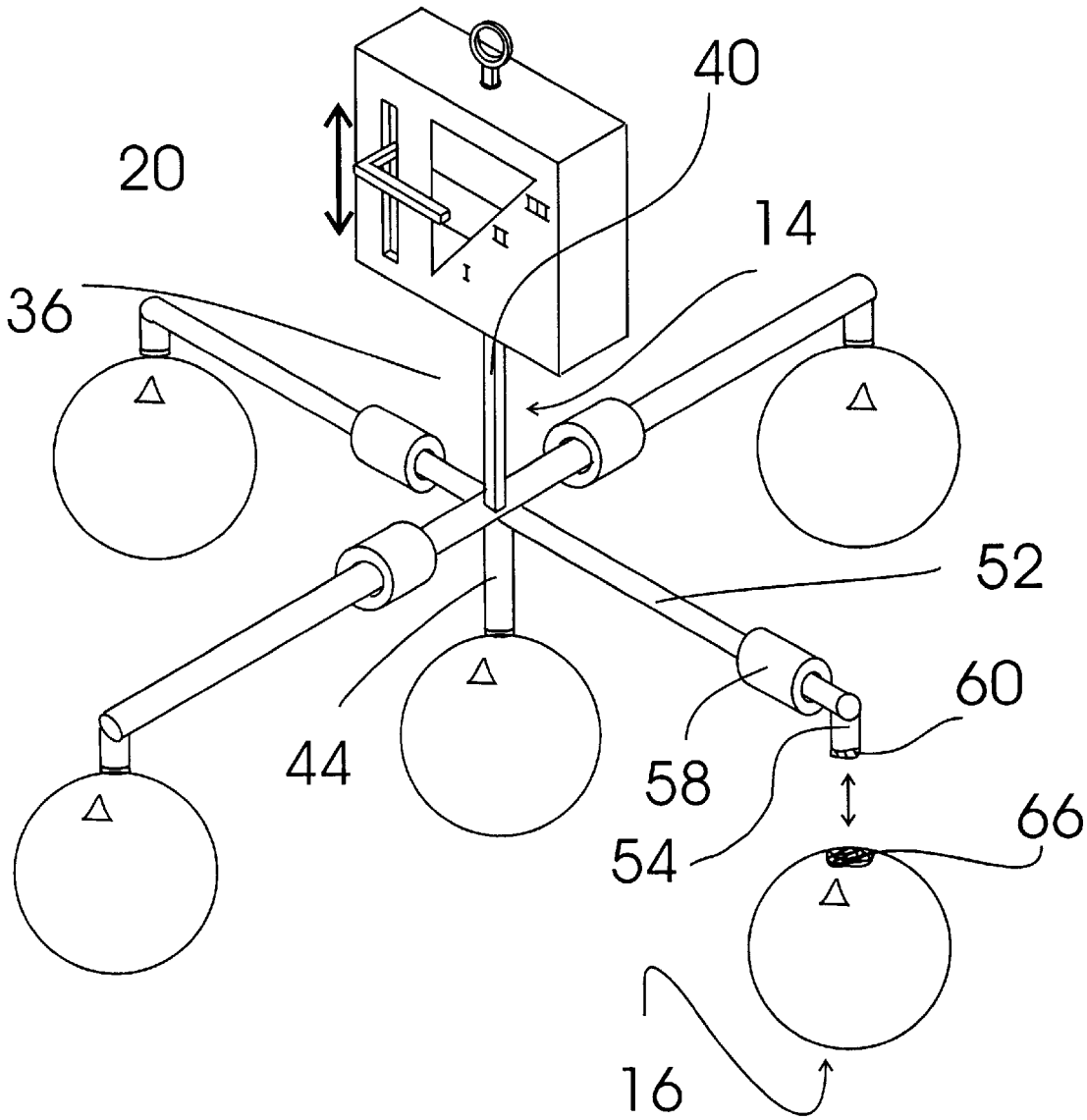
FIG. 3 is a perspective view of the exemplary powered infant mobile of FIG. 1 showing one of the mobile elements detached from the short portion of one of the L-shaped support arms of the mobile support frame and the slidable balancing element on the long portion of that L-shaped support arm moved away from the vertical center member toward the short portion to compensate for the weight of the removed mobile element and to thereby maintain the vertical center member in a vertical orientation.

Mobile support frame 14 is of molded plastic Construction and includes a vertical center member 36 having a top end 40 fixedly attached to a center of a bottom surface 42 of motor housing 20 and extending downwardly away from bottom surface 42 of motor housing 20 terminating at a far end 44 in a mobile element detachable attachment mechanism 46 and four equally spaced, equally sized L-shaped support arms 50 each, referring now to FIG. 3, including a long portion 52 and a short portion 54. Each long portion 52 extending radially from the same section of vertical center member 36 at a location between far end 44 and top end 40. Each long portion also includes a tubular shaped slidable balancing element 58 that is slidable along the long portion 52 for allowing a user to balance mobile support frame 14 such that vertical center member 36 is maintained in a vertical orientation. Each short portion 54 is oriented downward away from motor housing 20 and terminates in a mobile element detachable attachment mechanism 60, in this embodiment a section of hook and pile fastener material.

Although each of the five mobile elements 16 in this embodiment is a stuffed animal character it should be understood that a variety of items can be used as mobile elements 16. Each mobile element 16 has a frame detachable attachment mechanism 66, a section of hook and pile fastener material companionate with the mobile element detachable attachment mechanisms 60 for detachably attaching each mobile element 16 to mobile support frame 14.

It can be seen from the preceding description that a powered infant mobile has been provided that includes a drive assembly including a motor housing having a timer select switch provided on the exterior thereof, a battery powered drive motor controlled by the timer select switch and rigidly coupled to the interior of the motor housing such that a rotatable shaft extends outwardly from the motor housing through a top surface thereof, the rotatable shaft terminating in a hanging ring, operation of the battery powered drive motor causing the motor housing to rotate with respect to the rotatable shaft; a mobile support frame including a vertical center member having a top end fixedly attached to a center of the bottom surface of the motor housing and extending downwardly away from the bottom surface of the motor housing terminating at a far end in a mobile element detachable attachment mechanism and four equally spaced, equally sized L-shaped support arms each including a long portion and a short portion, each long portion extending radially from the same section of the vertical center member at a location between the far end and the top end, each long portion having a slidable balancing element provided thereon for allowing a user to balance the mobile support frame such that the vertical center member is maintained in a vertical orientation, each short portion being oriented downward away from the motor housing and terminating in a mobile element detachable attachment mechanism; and at least five mobile elements each having a frame detachable attachment mechanism companionate with a mobile element detachable attachment mechanism for detachably attaching each mobile element to the mobile support frame.

It is noted that the embodiment of the powered infant mobile described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A powered infant mobile comprising:

a drive assembly including a motor housing having a timer select switch provided on an exterior thereof, a battery powered drive motor controlled by said timer select switch and rigidly coupled to an interior surface of the motor housing such that a rotatable shaft of said battery powered drive motor extends outwardly from said motor housing through a top surface thereof, said rotatable shaft terminating in a hanging ring, operation of said battery powered drive motor causing said motor housing to rotate with respect to said rotatable shaft;

a mobile support frame including a vertical center member having a top end fixedly attached to a center of a bottom surface of said motor housing and extending downwardly away from said bottom surface of said motor housing terminating at a far end in a mobile element detachable attachment mechanism and four equally spaced, equally sized L-shaped support arms each including a long portion and a short portion, each long portion extending radially from a section of said vertical center member at a location between said far end and said top end, each long portion having a slidable balancing element provided thereon for allowing a user to balance said mobile support frame such that said vertical center member is maintained in a vertical orientation, each short portion being oriented downward away from said motor housing and terminating in a mobile element detachable attachment mechanism; and five mobile elements each having a frame detachable attachment mechanism companionate with a mobile element detachable attachment mechanism for detachably attaching each mobile element to said mobile support frame.

* * * * *